US005396663A

United States Patent [19]

Burgess

[11] Patent Number: 5,396,663

[45] Date of Patent: Mar. 14, 1995

[54] PIN AND ASSEMBLY FOR QUICK RELEASE TOILET SEAT

[76] Inventor: Sheridan L. Burgess, 680 Clark St., Gardner, Mass. 01440

[21] Appl. No.: 159,793

[22] Filed: Nov. 29, 1993

[51] Int. Cl.[6] ..... A47K 13/12

[52] U.S. Cl. ..... 4/237; 4/234; 215/359

[58] Field of Search ..... 4/234, 240, 237; 215/279, 283, 292, 359, 351, 362, 363; 220/233-238; 411/8, 276, 277, 278, 282, 361, 375; 403/223, 224, 227, 277, 281, 372, 374

[56] References Cited

U.S. PATENT DOCUMENTS

| | | | |
|---|---|---|---|
| 408,364 | 8/1889 | Trant . | |
| 875,397 | 12/1907 | Willis . | |
| 1,212,871 | 1/1917 | Abbott . | |
| 2,365,372 | 12/1944 | Allen | 45/137 |
| 2,593,534 | 4/1952 | Campenelli | 4/240 |
| 2,846,697 | 8/1958 | Phillips | 4/240 |
| 2,940,629 | 6/1960 | Cros | 215/359 |
| 3,055,015 | 9/1962 | Silverman | 4/240 |
| 3,449,774 | 6/1969 | Wilham | 4/240 |
| 3,841,371 | 10/1974 | Thurston | 411/276 |
| 3,842,877 | 10/1974 | Andrews | 411/277 |
| 4,214,672 | 7/1980 | Peniche | 215/359 |
| 4,970,731 | 11/1990 | Fait | 4/234 |

*Primary Examiner*—Henry J. Recla
*Assistant Examiner*—Gregory M. Vidovich
*Attorney, Agent, or Firm*—Ellen C. Childress

[57] ABSTRACT

A central spindle which at the base end is eccentric. The central spindle is surrounded by a sleeve which is deformed and expands its effective diameter at the base when the spindle is turned. To release, the spindle is turned in the opposite direction, and the seat assembly may be removed. The device is particularly useful for attaching a toilet seat.

8 Claims, 6 Drawing Sheets

FIG. 3A
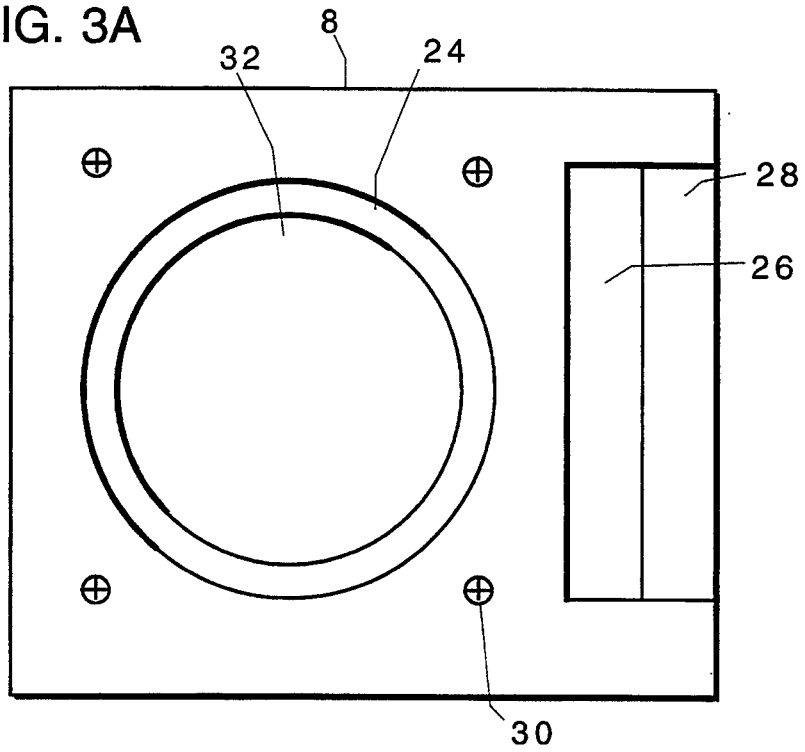
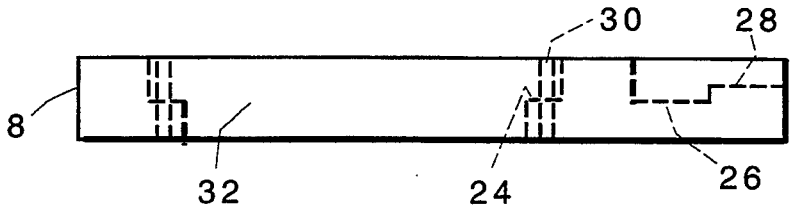
FIG. 3B

FIG. 4A
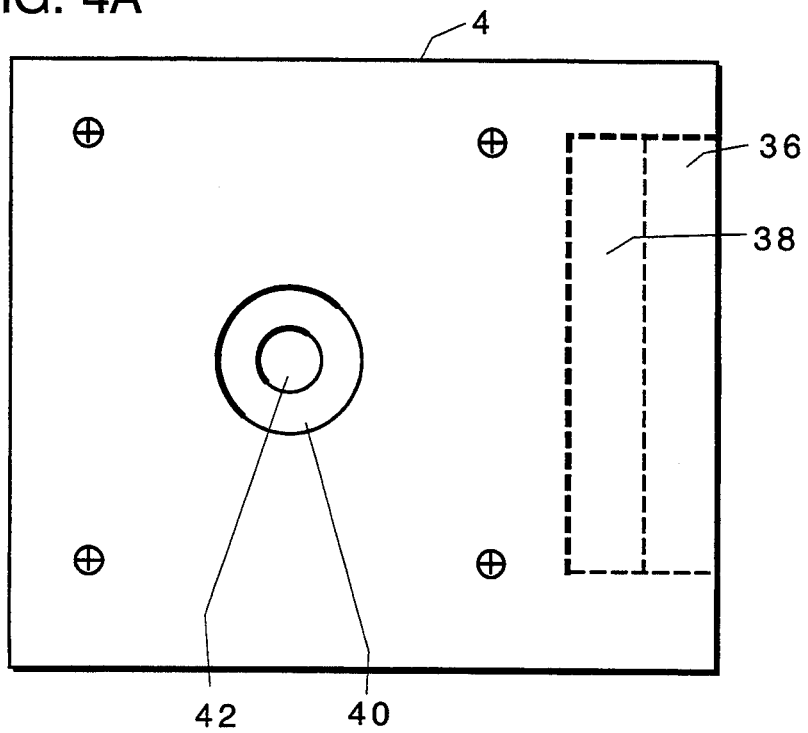
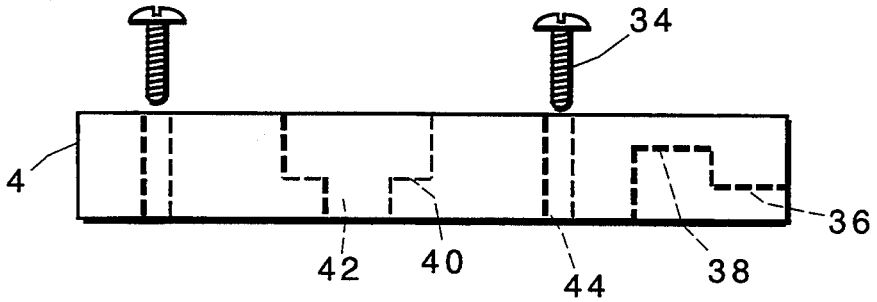
FIG. 4B

PIN AND ASSEMBLY FOR QUICK RELEASE TOILET SEAT

FIELD OF THE INVENTION

This invention relates to fasteners having an expandable, sleeve having a quick release feature.

BACKGROUND OF THE INVENTION

Toilet seats are removed for replacement, repairs to the toilet, and cleaning. Most toilet seat assemblies are presently fastened to the toilet by means of fasteners which insert from the top of a hole and into a connector on the bottom of the hole, the most familiar example being a nut and bolt. Such assemblies require the use of tools for installation and removal. Metal fasteners tend to corrode and bind while plastic fasteners of this type tend to loosen with use. Recognition of the difficulties presented in such fasteners has prompted several alternative assemblies.

U.S. Pat. No. 2,593,534, discloses a cam locking fastener, which replaces the nut in a typical toilet seat assembly.

U.S. Pat. No. 3,055,015, discloses a releasable hinge assembly which has an expandable section at the base of the fastener which can be contracted by squeezing. The expanded section replaces the nut.

U.S. Pat. No. 3,449,774, discloses an attachment device having a deformable sleeve which expands at sides and base to hold the seat. Deformation is done by an internal nut.

Fasteners with expandable and deformable sleeves are used for attaching and sealing a number of devices. Among the earliest of these are bottle stoppers such as those shown in U.S. Pat. Nos. 408,364, 875,397, and 1,212,871. Fasteners include U.S. Pat. No. 2,365,372, which is a hold-down attachment for a trolly seat. However, these generally have used a cylindrical center, which expands a cylindrical sleeve. Devices which use permanently installed pieces are unsatisfactory since the piece traps dirt.

It is desirable to have a fastener which makes it easy to install or remove a toilet seat assembly, and has no part permanently fastened to the toilet.

SUMMARY OF THE INVENTION

It is an objective of this invention to provide a means of removing and installing a toilet seat assembly easily and completely, from above the seat structure.

The present invention has a central spindle which at the base end is eccentric. The central spindle is surrounded by a sleeve which is deformed and expands its effective diameter at the base when the spindle is turned. To release, the spindle is turned in the opposite direction, and the seat assembly may be removed.

BRIEF DESCRIPTION OF THE DRAWINGS

FIGS. 3A and 3B are top and side views of the assembly base.

FIGS. 4A and 4B are top and side views of the assembly top.

DETAILED DESCRIPTION OF THE DRAWINGS

Figure 1:
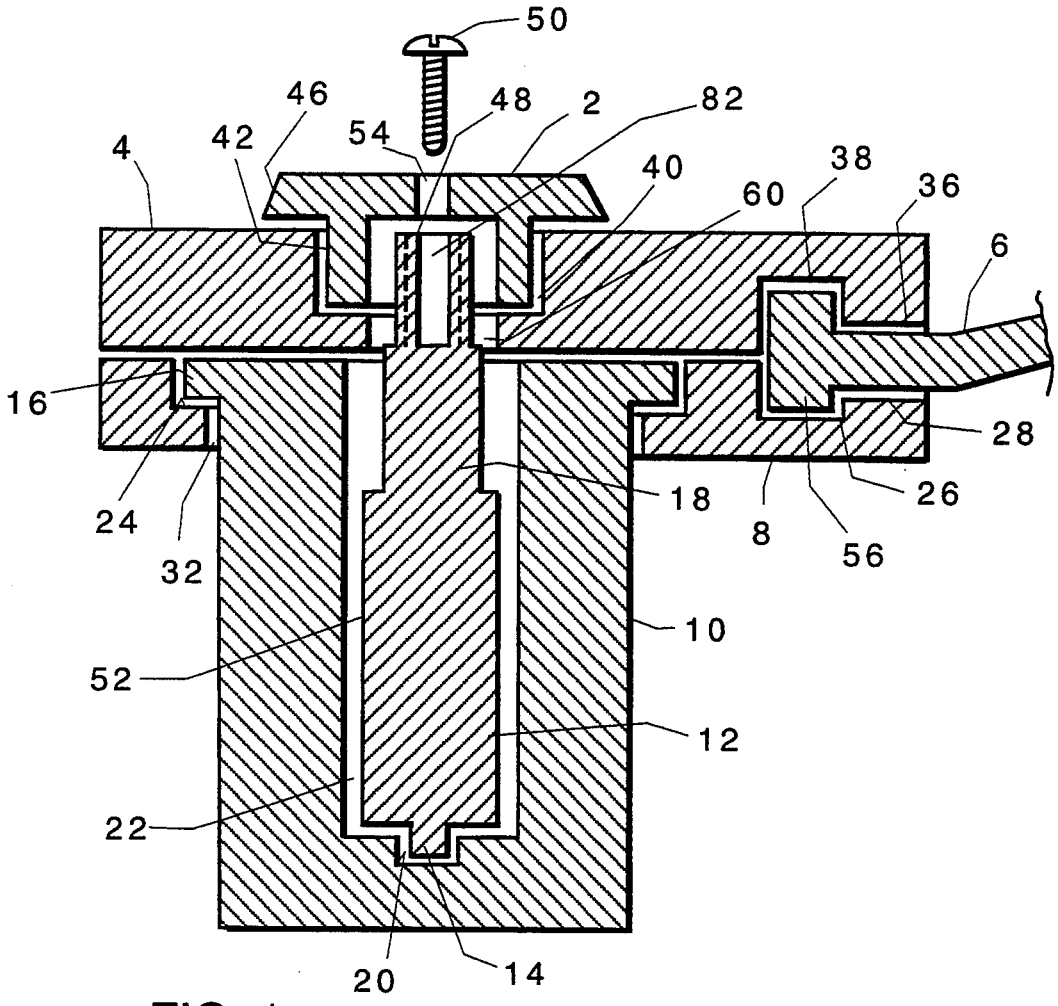
FIG. 1 is a cross sectional view of a fastener and seat assembly according to the invention.
Figure 2:
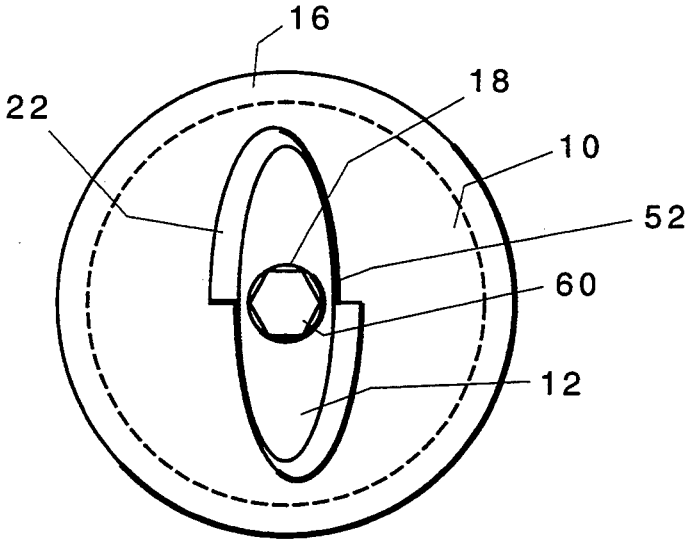
FIG. 2 is a top view of the spindle and sleeve of the fastener.
Figure 6:
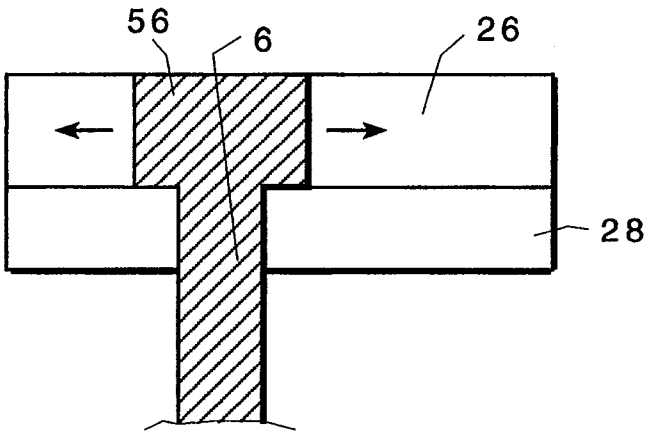
FIG. 6 is a cross sectional view of an arm seated between the assembly base and top.
Figure 5A:
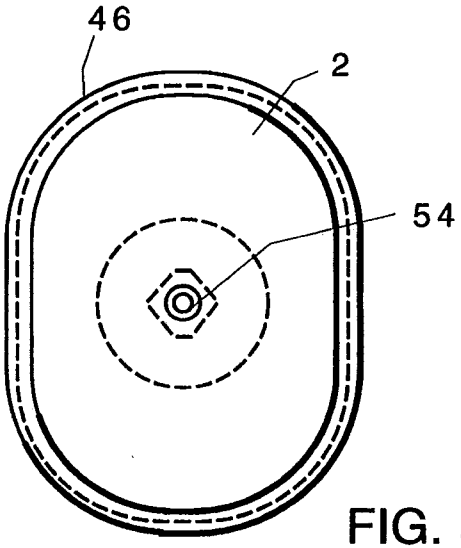
FIG. 5A and 5B are top and side views of a spindle cap.
Figure 5B:
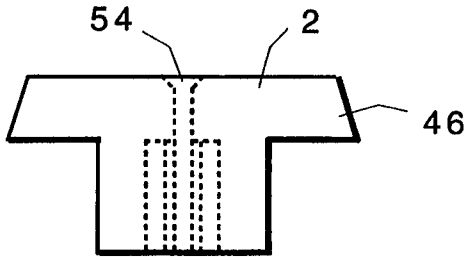

FIG. 1 shows a preferred embodiment of the invention. The assembly has a base 8 and top 4 which are cooperative to hold a deformable sleeve 10 and moveable arm 6 of a toilet seat. The base 8, as seen in FIGS. 3A and 3B has a recessed surface 28 and adjacent groove 26 to accommodate a range of arms 6, a circular shelf 24 and aperture 32 for holding the sleeve 10 and connection apertures 30 for connection with the top 4. The top 4 has a recessed surface 36 and adjacent groove 38 to accommodate the arm 6, a recessed shelf 40 to accommodate the spindle cap 2, a spindle aperture 42 and connection apertures 44 which allow connection of the top and base by fasteners such as threaded fasteners 34. The spindle 52 has a relatively slender upper section 18 having a polygonal tip 60, an oval section 12, and a round centering section 14. The round upper section has a cap connection recess 82. The oval section 12 looks rectangular when viewed from the side. The sleeve 10 has a circular flange 16 and outer perimeter, a central bore 22, and a circular spindle guide recess 20. The central bore 22 is shape similar to to an oval which has been split and shifted, hereafter referred to as a shifted oval. The spindle cap 2 has a polygonal spindle recess 48 for receiving the tip 60 of the spindle 18, a knob 46 with textured side for easy gripping, and an aperture 54 to allow connection to the spindle top 18 by a threaded fastener 50. The arm 6 has a retaining bulge 56 and the width of the arm 6 is smaller than the channel formed by the top 8 and base 4 assembly, providing freedom of motion in the direction of the arrows.

Figure 8:
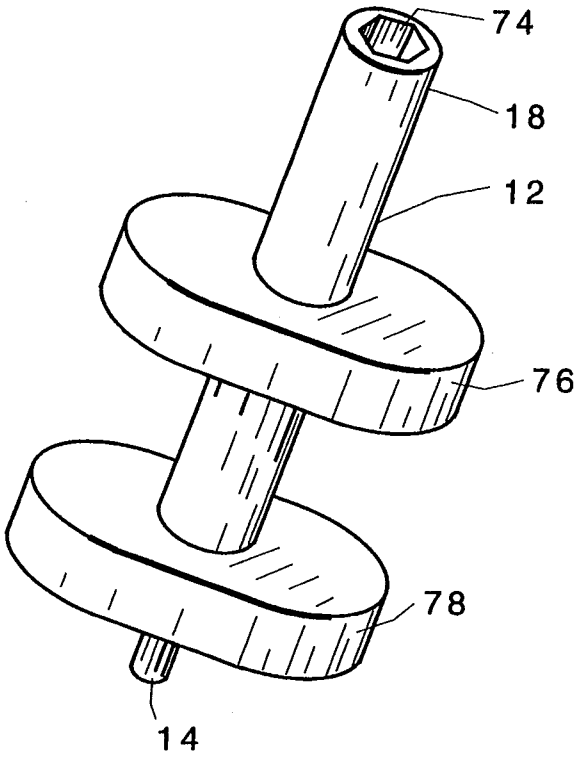
FIG. 8 is a perspective view of a spindle for expansion above and below a joint.

An alternative preferred embodiment shown in FIG. 8 shows one of many variations possible. In place of a spindle top 18 and cap 2, the spindle has been provided with a socket 74 suitable for a hexagonal wrench. Other variations are possible, for example, the spindle 12 and cap 2 can be molded as one piece or the spindle top 18 be provided with one or more flat or keyed sides, and the spindle recess 48 has a matching flat or keyed side.

While the embodiment show is locked into place by outward side pressure (suitable for a blind fastener), lower placement of the oval section of the spindle can also be used to provide a bottom locking mechanism where expansion occurs below the level of the ceramic toilet due to creation of a larger effective diameter of the fastener after applying the locking mechanism. It is also possible that the eccentric spindle and sleeve configuration could be used as an "expansion" fastener in other applications, such as when a releasable blind fastener is desired or even for sealing bottles.

When the eccentric oval portion of the spindle 12 is inserted into a sleeve with the same oblong axis orientation of the bore 22, no pressure is exerted radially from the concentric axis. When spindle 12 is rotated counterclockwise from the shown nonengaged position, it presses outward against the split oval bore 22 deforming the outer perimeter outward to effectively increase the diameter. A maximum deformation is achieved at 90 degrees. To release the fastener, clockwise rotation releases deformation, allowing removal of the fastener. Rotation of the cap 2 translates to turning to the spindle 12, to secure or release the assembly.

Figure 9:
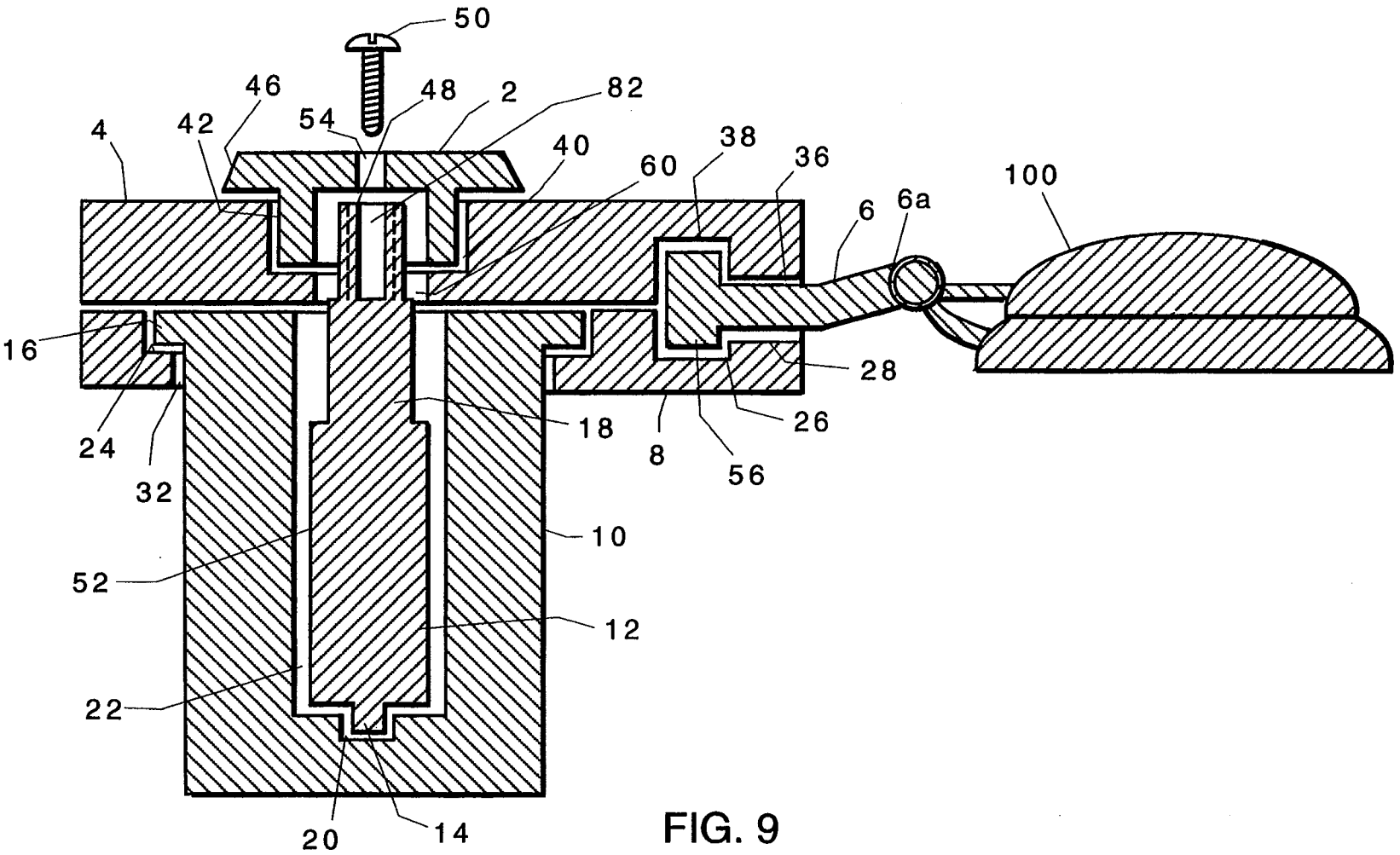
FIG. 9 is a cross sectional view of a fastener and seat assembly according to the invention.

FIG. 9 shows a seat assembly for connection to a toilet. The seat 100 is located at one end 6*a* of the arm 6.

Suitable materials for the manufacture of the sleeve include elastomerics such as natural and synthetic rubber, polymers such as neoprene silicon based polymers. Suitable materials for the manufacture of the spindle include rigid materials such as metal, wood, and rigid polymers such as acrylics, polypropylenes and polyethylenes. The base and top assemblies can be made from decorative plastic, metal or wood.

Figure 7:
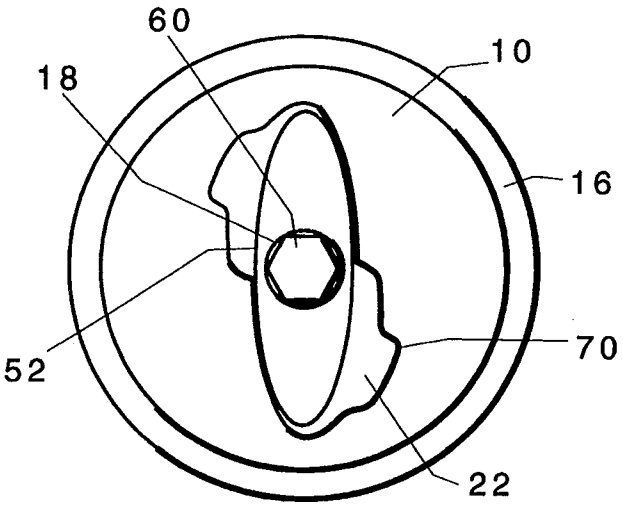
FIG. 7 is a top view of a spindle and sleeve for fastener having two degrees of tension.

By adding a notch 70 (FIG. 7) to the eccentric bore at about 45 degrees from the nonengaged axis, a fastener having two degrees of tightness can be formed. Because porcelain can break if too much pressure is applied, multiple notches could allow the degree of tightness to be controlled.

If the sleeve is made of a compressible waterproof material such as neoprene, tightening the fastener can also seal an aperture. This feature could be used when attaching the toilet tank to the back of the toilet. Presently, threaded fasteners are inserted within the tank and anchored below a ledge on the toilet, which is awkward to reach. If the threaded fastener is tightened insufficiently, the connection will leak. If it is tightened too firmly, the porcelain will crack. If a split oval fastener having multiple settings is made, preferably having two eccentric layers 76 and 78, the fastener could make installation of the tank much easier.

The present inventions allows easy attachment and detachment of a toilet seat from above the toilet. The fastener can be used in other applications.

What is claimed is:

1. A quick release toilet seat assembly comprising:

a toilet seat fastener comprising a base having an attachment aperture therethrough;

a sleeve having an eccentric split oval bore therein, said sleeve having an axis substantially parallel to length of said sleeve and an upper flange, said sleeve having an outer perimeter smaller than said aperture, said sleeve being placed in said aperture;

a spindle having an elongated eccentric section, and an axis concentric with said bore axis, located in said eccentric bore whereby when said spindle is rotated in said bore said sleeve is deformed to exert pressure radially from said concentric axis along the length of the sleeve.

2. The assembly of claim 1 wherein said toilet seat fastener further comprises:

an arm having two ends, said arm being connected to a toilet seat at one end and having a retaining means connected on the other end; and said base further including an arm retainer formed thereon for holding said retaining means.

3. The assembly of claim 2 wherein said retainer further comprises:

a channel said retaining means shaped to be received in said channel.

4. The assembly of claim 2 wherein said arm retainer further comprises:

a top in connection with said base, said base further having a retaining ledge for supporting said flange.

5. The assembly of claim 4 wherein said top further comprises a spindle aperture for receipt of said spindle.

6. A fastener comprising:

a sleeve having an eccentric split oval bore therein, said sleeve having an axis substantially parallel to the length of said sleeve; and a spindle having at least two eccentric cross sections thereon placed within said sleeve, said cross sections being vertically separated by a section of said spindle having cross-sectional area less than the cross-sectional area of either of said eccentric cross sections, and an axis concentric with said bore axis located in said eccentric bore whereby when said spindle is rotated in said bore said sleeve is deformed to exert pressure radially from said concentric axis.

7. A quick release toilet seat assembly comprising:

a toilet seat fastener comprising a base having an attachment aperture therethrough;

a sleeve having an eccentric bore therein, said sleeve having an axis substantially parallel to the length of said sleeve and an upper flange, said sleeve having an outer perimeter smaller than said aperture, said sleeve being placed in said aperture;

a spindle having an elongated eccentric section thereon placed with said sleeve, and an axis concentric with said bore axis, located in said eccentric bore whereby when said spindle is rotated in said bore said sleeve is deformed to exert pressure radially from said concentric axis along the length the sleeve;

said base further having means for supporting said flange;

an arm having two ends, said arm being connected to a toilet seat at one end and having a retaining means connected on the other end; and an arm retainer formed within said base for holding said retaining means, wherein said retainer further comprises:

a top in connection with said base, said means for supporting said flange comprises a retaining ledge for said flange, wherein said top further comprises a spindle aperture for receipt of said spindle, wherein said top and base are provided with mating channels for retaining said retaining means.

8. A quick release toilet seat assembly comprising:

a toilet seat fastener comprising a base having an attachment aperture therethrough;

a sleeve having an eccentric split oval bore therein, said sleeve having an axis substantially parallel to the length of said sleeve and an upper flange, said sleeve having an outer perimeter smaller than said aperture, said sleeve being placed in said aperture;

a spindle having an elongated eccentric section thereon placed within said sleeve, and an axis concentric with said bore axis, located in said eccentric bore whereby when said spindle is rotated in said bore said sleeve is deformed to exert pressure radially from said concentric axis along the length of the sleeve;

said base further having means for supporting said flange;

an arm having two ends, said arm being connected to a toilet seat at one end and having a retaining means connected on the other end; and an arm retainer formed within said base for holding said retaining means, wherein said arm can move laterally in said channel.

* * * * *